US009181913B2

(12) United States Patent
Kellermann

(10) Patent No.: US 9,181,913 B2
(45) Date of Patent: Nov. 10, 2015

(54) STARTER FOR A POWER TOOL WITH IMPROVED KINEMATICS

(75) Inventor: Christian Kellermann, Grande (DE)

(73) Assignee: MAKITA CORPORATION, Aichi (JP)

( * ) Notice: Subject to any disclaimer, the term of this patent is extended or adjusted under 35 U.S.C. 154(b) by 768 days.

(21) Appl. No.: 13/483,183

(22) Filed: May 30, 2012

(65) Prior Publication Data

US 2013/0000587 A1 Jan. 3, 2013

(30) Foreign Application Priority Data

Jun. 28, 2011 (DE) ..... 20 2011 050 571 U

(51) Int. Cl.
*F02N 1/00* (2006.01)
*F02N 3/02* (2006.01)

(52) U.S. Cl.
CPC ... *F02N 3/02* (2013.01); *F02N 1/00* (2013.01)

(58) Field of Classification Search
CPC ..... F02N 1/00; F02N 3/02; F02N 5/02; F02N 5/04
USPC ..... 123/185.1–185.13
See application file for complete search history.

(56) References Cited

U.S. PATENT DOCUMENTS 5,287,832 A * 2/1994 Uhl ..... 123/185.3
7,806,097 B2 * 10/2010 Kellermann ..... 123/185.3
2011/0094468 A1 * 4/2011 Kellermann ..... 123/185.3

FOREIGN PATENT DOCUMENTS

DE 10 2008 021 196 11/2008
DE 10 2008 021 197 11/2008

* cited by examiner

*Primary Examiner* — Thomas Moulis
(74) *Attorney, Agent, or Firm* — Greenblum & Bernstein, P.L.C.

(57) ABSTRACT

Starter for starting a combustion motor for a power tool includes a rotating tension means roller, onto which a tension means can be wound and which via active connection is connected to a entrainment means of the combustion motor in order to introduce a rotating movement into the combustion motor. The active connection has at least one double crank gear between the tension means roller and the entrainment means.

13 Claims, 2 Drawing Sheets

STARTER FOR A POWER TOOL WITH IMPROVED KINEMATICS

The present invention relates to a starter for starting a combustion motor, more particularly for a power tool with a rotating tension means roller, onto which a tension means can be wound and which via an active connection is connected with an entrainment means of the combustion motor in order to introduce a rotating movement into the combustion motor.

PRIOR ART

From DE 10 2008 021 196 A1 a starter for starting a combustion motor of a power tool is known and a rotating tension means roller is shown onto which a tension means can be wound and which via an active connection is connected to a drive plate of the combustion motor in order to introduce a rotating movement into the combustion motor.

At the end of the tension means there is a grip and at the grip a tensile force can be introduced into the tension means in order to start the combustion motor.

By way of an active connection with the drive plate the rotating movement is transmitted to the combustion motor and the drive plate performs at least the same rotating movement as the crankshaft of the combustion motor. Due to the design of the combustion motor the crank shaft has a torque band which periodically changes over the full rotation of the crankshaft. During the compression phase of the combustion motor a high torque is required which has to be transmitted to the crankshaft in order initiate its rotating movement. During the expansion phase, on the other hand, the crankshaft only requires a small toque or no torque, as through the expansion of the gas in the combustion chamber of the combustion motor a gas spring effect is produced so that the crankshaft is turned by itself. This strong period torque band of the combustion motor to be started generates a corresponding increasing and decreasing force in the tension means which the user must expend and perceives as a jerky, pulsating loading.

In order to dampen the force peaks produced by the period torque band in the tension means, a deformation element is proposed in the active connection between the tension means roller and the drive plant, in which lagging or racing of the crankshaft of the tension means roller can be evened out. In this way the force peaks are reduced, resulting in increased operating comfort of the start and therefore of the power tool.

From DE 10 2008 021 197 A1 a further starter for starting a combustion motor is known, and the active connection between the tension means roller and an entrainment means comprises a coupling rod which interacts with a lever arm. This results in an active connection between the tension means roller and the entrainment means, which brings about a different angle between the tension means roller and the entrainment means. Disadvantageous, however, is the fact that a further coupling element is required for coupling the starter to the entrainment means. Once the combustion motor has started it must be uncoupled from the starter for which latch elements must be arranged on the entrainment means which engage in the coupling element when the starter is activated and the combustion motor has not yet started.

Here, it can occur that the latch element can only engage in the coupling element after almost a complete rotation of the tension means roller. This results in a drawback for operating the starter, as a considerable length of the tension means first has to be unwound from the tension means roller in order to achieve engagement of the latch elements of the entrainment means in the coupling element.

In accordance with one form of embodiment the problem of the maximum required turning angle is solved in that two joint socket geometries are provided in a position 180° opposite each other on the tension means roller, but with the drawback that this design does not work satisfactorily in practice. In addition, the pole wheel has a coupling element that differs from a widely used conventional standard. In a conventional pole wheel latches are used. This means that two different pole wheels have to be provided, depending on which type of starter is being built. As an additional disadvantage the centrifugal element must engage in a drive lying eccentric to the pole wheel. Over a rotation of the pole wheel this results in asymmetrical behaviour of the engagement of the centrifugal element.

It is therefore the objective of the present invention to create a starter for starting a combustion motor which overcomes the disadvantages of the above prior art and can even out changeable torque between the tension means roller and the combustion motor, whereby, more particularly a starter is to be created which allows active connection between the tension means roller and the entrainment means of the combustion motor after considerably less than a full rotation of the tension means roller.

This objective is achieved in the basis of a starter for a power tool in accordance with the introductory section of claim 1 in conjunction with the characterising features. Advantageous further developments of the invention are set out in the dependent claims.

DISCLOSURE OF THE INVENTION

The invention includes the technical teaching that the active connection between the tension means roller and the entrainment means has at least one double crank gear.

Double crank gears belong to the group of four-joint coupling gears, so that the gear has four coupling elements, with the coupling elements being connected to each other by means of joints. More particularly, two joint points can be designed as joint points fixed on the housing, so that between the fixed housing joint point the coupling element can be dispensed with. Consequently, double crank gears have a drive element, a output member and a coupling element, and the coupling element extends between the free ends of the drive element and of the output member. The drive element is rotatably borne in a first joint point and the output member is rotatably borne in a second joint point, and when the drive element is rotated about the first joint point the output member performs a rotating movement about the second joint point which results in an angle displacement between the drive element and the output member over the full rotation of the elements.

A particular advantage is achieved if the active connection between the tension means roller and the entrainment means has at least two double crank gears. This results in the advantage that the tension means roller does not have to complete a full rotation in order to achieve engagement of the entrainment means with the tension means roller, and if a second double crank gear is arranged between the tension means roller and the entrainment means an active connection between the tension means roller and the entrainment means can come about after a maximum rotation of the tension means roller of 180°. For example the tension means roller can have a diameter of 70 mm so that there is a maximum tension length of the tension means of 100 mm until the active connection of the tension means roller engages with the entrainment means of the combustion motor.

In accordance with an advantageous form of embodiment, the tension means roller has a flat side, whereby the at least one double crank gear is arranged on the flat side of the tension means roller. The tension means roller can be in the form of a disk and the double crank gear is dimensioned so that the double crank gear can be arranged on the flat side of the tension means roller. If, in accordance with the invention, two double crank gears are envisaged, both double crank gears are arranged on the tension means roller.

More particularly, two double crank gears can be arranged in a position offset by 180° with regard to each other on the flat side of the tension means roller, whereby in an arrangement of more than two double crank gears an even distribution about the circumference of the tension means roller is envisaged.

Through the arrangement of two more double crank gears between the tension means roller and the entrainment means the components of a double crank gears with the corresponding elements, more particularly with the den drive elements, the output member and the coupling elements are all present in double or multiple form. Through, for example, a double, 180° offset arrangement of the double crank gears the engagement of the entrainment means with the tension means roller through the active connection takes place after a rotation of the tension means roller by around 180° at the latest. In the case of a triple arrangement of double crank gears the required rotation of the tension means roller can be reduced to around 120°, whereby with a further increase in the number of double crank gears this results in a further reduction in the required rotation of the tension means roller.

In accordance with a preferred form of embodiment a roller holder element is provided with an axis of rotation that is fixed and more particularly rigidly arranged in the structure of the power tool. On the roller holder element the tension means roller can be held rotatably about the axis of rotation and the roller holder element forms a resting first joint point of the at least one double crank gear which lies in the axis of rotation of the tension means roller. The roller holder element can, for example, be cylindrical in form and rotatably borne on the lateral surface of which is the tension means roller, which has a centrally bored hole, through which the roller holder element extends. The roller holder element can form the resting first joint for both double crank gears arranged on the tension means roller, so that first resting joint point of both double crank gears lie in each other.

The double crank gear is designed and arranged on the tension means roller so that the tension means roller forms a drive element of the at least one double crank gear, whereby arranged on the tension means roller at a distance from the axis of rotation there is at least one joint element, on which one end of a coupling element of the double crank gears arranged in an articulated manner. Furthermore, the roller holder element, on which tension means roller is rotatably held, has a resting second joint of the at least one double crank gear, which lies at a distance from the axis of rotation of the tension means roller and which is concentrically arranged with the crankshaft of the combustion motor.

In addition an output member for forming the double crank gears is provided which extends between the resting second joint point and the free joint element, in which the output member is connected with the coupling element. If the tension means roller is rotated, the distance of the joint element on the tension means roller to the second joint point on the roller holder element changes. As a result, the angle between the longitudinal extent of the coupling member and the longitudinal extent of the output member changes. Consequently the distance of the free joint element to the axis of rotation changes through the rotating movement of the tension means roller. In this way it is possible for the rotating movement of the tension means roller to be picked up by the entrainment means and angle displacement can take place between rotation angle of the joint element about the axis of rotation relative to the rotation angle of the tension means roller about the axis of rotation. Therefore the smaller the selected length of the coupling element, the greater the angle displacement becomes.

As a further advantage the entrainment means can be coupled to the free joint element. If two double crank gears are envisaged, the entrainment means can have two locking hooks into each of which a joint element of a double crank gears engages. In this way the required kinematics are created in the active connection between the tension means roller and the entrainment means in order to attenuate the periodic torque of the entrainment means in the transmission to the tension means roller, and it is also achieved that the tension means roller has to be turned by a maximum of 180° about the axis of rotation until the active connection between the tension means roller and the entrainment means engages.

More particularly it can be envisaged that the free joint element of the first the double crank gear is arranged around 180° opposite the free joint element of the second double crank gears.

As a further advantage the entrainment means can have an axis of rotation whereby the second joint point lies in the axis of rotation of the entrainment means.

The objective of the present invention is also achieve by a power tool with a starter for starting a combustion motor of the power tools, whereby the starter has rotating tension means roller on which a tension means can be wound and which via an active connection is connected to an entrainment means of the combustion motor in order to introduce a rotating movement into the combustion motor, whereby in accordance with the invention it is envisaged that the active connection between the tension means roller and the entrainment means has at least one double crank gear. The above examples of embodiment and advantage of the starter can be used in the same way for the power tool.

BRIEF DESCRIPTION OF THE DRAWINGS

Further measures that improve the invention are set out below in more detail together with the description of a preferred example of embodiment of the invention with the aid of the figures. In these.

PREFERRED EXAMPLE OF EMBODIMENT OF THE INVENTION

Figure 1:
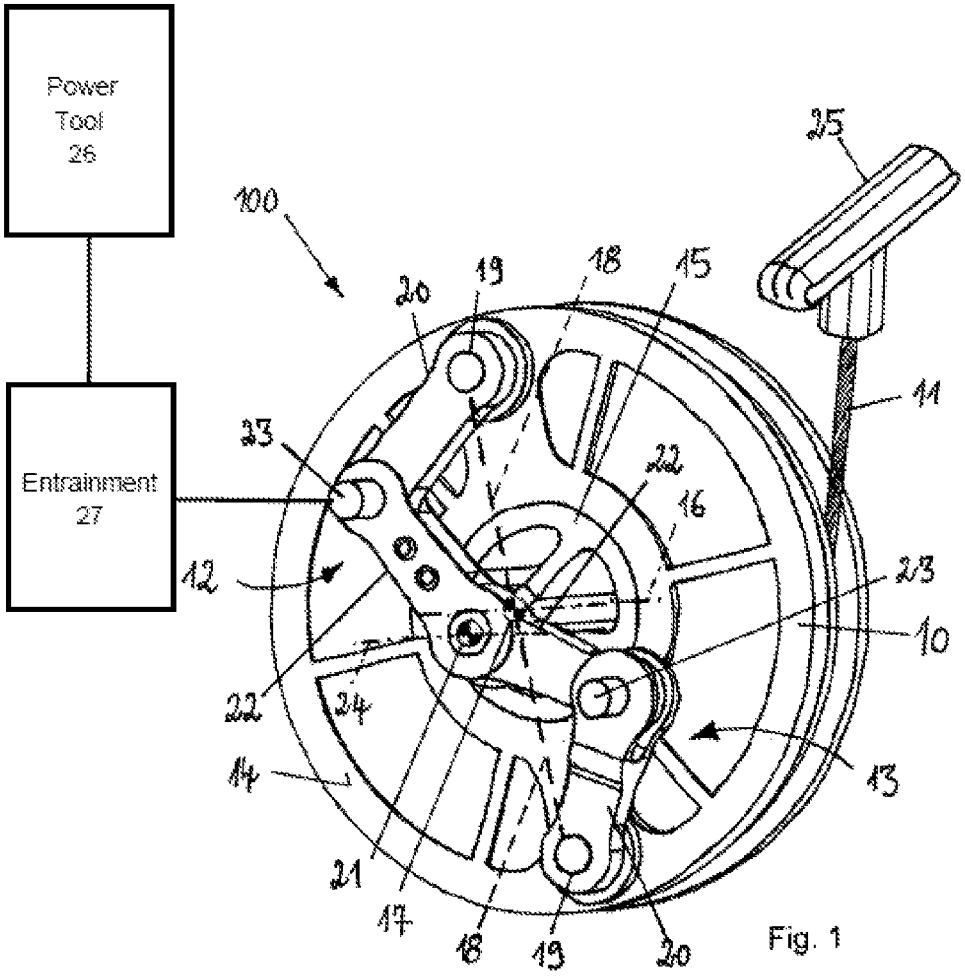
FIG. 1 shows perspective view of an example of embodiment of a starter for a power tool with the features of the present invention.

FIG. 1 shows a perspective view of a starter 100 for starting a combustion motor, as used, for example, for a power tool 26 such as chainsaw, a lawnmower, a grass trimmer, a cutting grinder or suchlike. The starter 100 has a rotating tension means roller 10 onto which a tension means 11 can be wound, and on the end of the tension means 11, shown for example as a pull cable, a grip 25 is provided. If an operator holds the grip 25 and introduces a tensile force into the tensions means 11, the tension means roller 10 is made to rotate. The rotational movement of the tension means roller 10 is transmitted via an active connection to an entrainment means, also referred to as an entrainment 27, and the entrainment means is connected to the combustion motor in order to introduce a rotating movement into the combustion motor. For this the entrainment is connected with the crankshaft of the combustion motor, whereby the active connection between the tension means roller 10 and the entrainment means is only in place for the starting phase of the combustion motor.

The active connection between the tension means roller 10 and the entrainment means is formed by two double crank gears 12 and 13. The tension means roller 10 has a flat side 14, and the double crank gears 12 and 13 are arranged on the flat side 14 of the tension means roller 10. The double crank gears 12 and 13 are arranged on the flat side of the tension means roller 10 in a position offset by 180° with regard to each other.

The tension means roller 10 is rotatably held in an axis of rotation 16 on a roller holder element 15. The axis of rotation 16 coincides with the central axis of the roller holder element 15. The roller holder element 15 is firmly integrated into the structure of the power tools so that the tension means roller 10 can be rotated about the fixed axis of rotation. With regard to the double crank gear 12 and 13 the das roller holder element 15 with the fixed axis of rotation 16 forms a first resting joint point 17 for both double crank gears 12 and 13, so that the first joint point 17 coincides for both double crank gears 12 and 13. Through the rotatability of the tension means roller 10 about the axis of rotation 16 the tension means roller 10 forms an output member 18 both for the first double crank gear 12 as well as for the second double crank gear 13. The drive elements 18 of both double crank gears 12, 13 are shown in dashed form as imaginary drive elements 18 and extend in a joint axis, so that the relevant drive elements 18 of the double crank gears 12 and 13 extend in the opposite direction from the axis of rotation 16.

On the tension means roller 10 on the outside of the flat side 14 and therefore at a distance from the axis of rotation 16 two joint elements 19 are arranged, which are in a position 180° opposite each other in relation to the axis of rotation 16. On rotation of the tension means roller 10 the joint elements 19 therefore rotate about the axis of rotation 16. The joint elements 19 are in the form of pegs or bolts and are firmly arranged on the flat side 14 of the tension means roller 10.

Each of the double crank gears 12 and 13 has a coupling element 20 which is held with a first end in a rotatable manner or the associated joint element 19.

The roller holder element 15 also has a second resting joint point 21, which serves as a resting joint point for both double crank gears 12 and 13, and whereby the resting joint point 21 is arranged at a distance from the axis of rotation 16 in the roller holder element 15.

At the resting, second joint point 21 one output member 22 is rotatably arranged for the first double crank gear 12 and one for the second double crank gear 13 whereby the second resting joint point 21 can also be in the form of a bolt or peg which extends from the face surface of the roller holder element 15. Both drive elements are thus rotatably arranged with a first end on the second joint point 21. In order to guarantee the function of the double crank gear 12 the second joint point 21 coincides with the crankshaft of the combustion motor.

Between the free, second end of the relevant drive element 22 in a joint element 23 the free side of the drive element 22 is connected in an articulated manner so that the drive elements 22 are connected to the coupling elements 20.

If the tension means roller 10 is rotated, rotation about the axis of rotation 16 takes place, which forms the first joint point 17 of both double crank gears 12 and 13. At a distance from the first joint point 17 the second joint point 21 is also arranged in a fixed manner on the roller holder element 15, and on rotation of the joint element 19 on the tension means roller 10 about the first joint point 17, the angle between the longitudinal extent of the coupling element 20 and the longitudinal extent of the output member 22 changes. In this way, depending on rotation angle of the tension means roller 10 about the axis of rotation 16, the distance between the joint element 23 and the axis of rotation 16 increases and decrease so that angle-independent torque transmission from the tension means roller 10 to the entrainment means can take place.

The joint elements 23 are designed a drive lugs and in a manner which is not shown in more detail latches can be provided on the entrainment means through which the joint elements 23 can be individually caught. If the joint element 23 is turned about the axis of rotation 16, a maximum rotation of around 180° is required for engaging with the latch of the entrainment means. The final active connection to the entrainment means is thus made possible via the joint element 23, in that the coupling element 20 is connected with the output member 22 of the relevant double crank gear 12 and 13. If the joint element 23 has just slipped by on the pole wheel latch, in the most unfavourable case a rotation of more than 180° may be necessary, whereby this drawback greater rotation being required can also occur when using only one double crank gear 12 or 13.

In this way, on the basis of simple mechanics, a smoothing out of the torque progression in the tension roller means 10 can take place via rotation of the entrainment means which is connected with the crankshaft of the combustion motor and into which the rotation angle-dependent torque is transmitted. If the piston of the combustion motor is in the compression phase, the distance of the joint element 23 from the axis of rotation 16 can be particularly small, so that a high toque can be transmitted to the entrainment means. If the piston is in the decompression phase of the combustion motor, via the corresponding angle element the distance of the joint element 23 from the axis of rotation can be correspondingly large.

Figure 2:
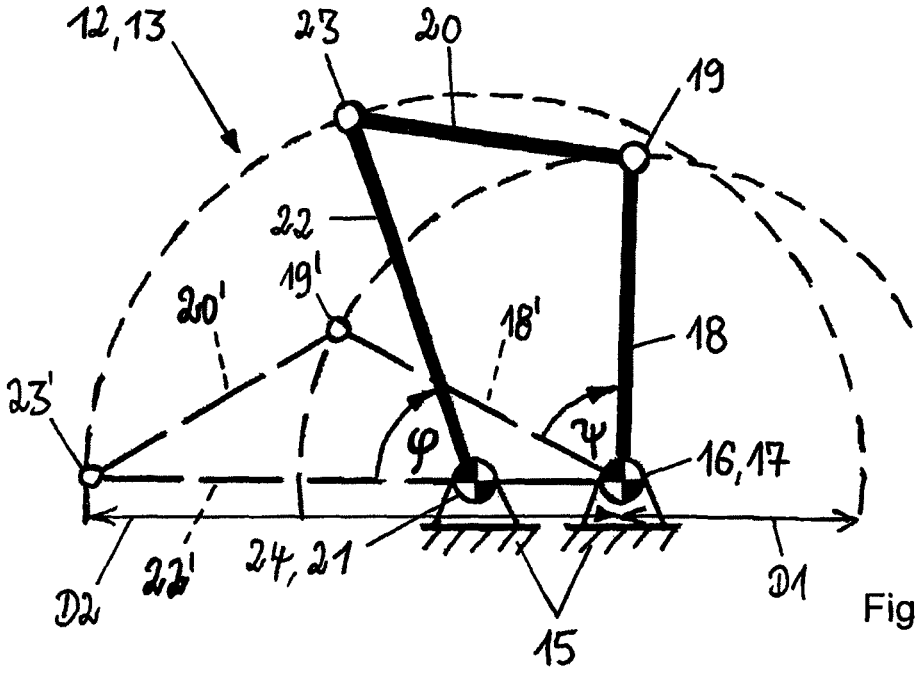
FIG. 2 shows a schematic view of a double crank gear that has the starter in accordance with the invention and FIG. 3 shows a diagram in which the angle of rotation of the output member is shown in relation to the rotation of the tension means roller over the crank angle.

FIG. 2 shows a schematic view of the double crank gear 12, 13, whereby the elements of the double crank gears 12, 13 are shown in a schematically abstracted manner. The roller holder element 15 is in the form of two spatially separated fixed bearings, whereby the bearings are fixed in the power tool. On the right the axis of rotation 16 in the roller holder element 15 is shown which forms the first joint point 17 of the double crank gears 12, 13. The fixed nearing on the left shows the second joint point 21 in the roller holder element 15, through which the axis of rotation 16 of the output member 22, 22' is formed.

In a first position the double crank gear 12, 13 with the drive element 18', the coupling element 20' and the output member 22' is shown in dashed form and after rotation of the output member 22' about rotation angle Ψ the drive element 18' is in the position of the drive element 18 shown in bold. The coupling element 20' moves into the position of the coupling element 20 shown in bold and the output member 22' moves into the position 22 shown in bold whereby the output member 22' rotates about rotation angle ϕ.

The joint element 23 performs a circular movement about the second joint point and it can be seen that, for example, in position D1 between the axis of rotation 16 and the imaginary path curve of the joint element 23, the distance D1 is considerable smaller than the distance D2 when the elements of the double crank gears 12, 13 are close to the position shown in a dashed manner.

As a result, by way of the arrangement in accordance with the invention of two double crank gears 12 and 13 a simple active connection between the tension means roller 10 and the entrainment means of the combustion motor of the power tool can be created, and via rotation angle ψ the distance between the joint element 23, 23' and the axis of rotation 16 can be greatly altered. Consequently, through full rotation of the tension means roller 10 the transmittable torque can be adjusted depending on the rotation angle of the compression behaviour of the piston in the cylinder so that a harmonic, even force is achieved over the entire tensile movement in the tension means 11.

Figure 3:
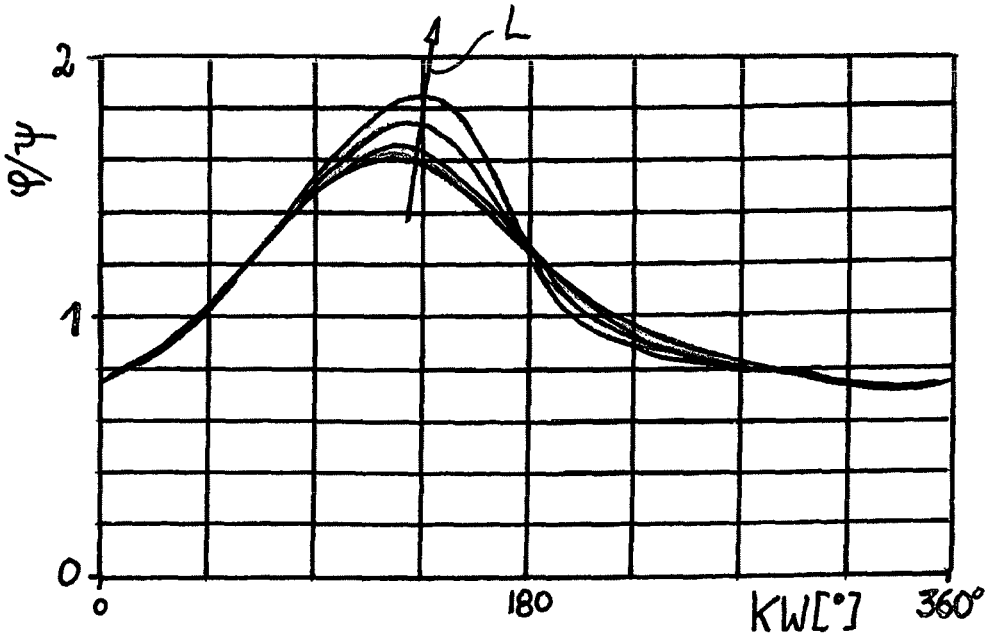

In FIG. 3 a diagram is shown of the course of the rotation angle ψ in relation to the rotation angle ϕ of the drive element to the output member via the crank angle 360°. It is clear that just before the lower dead point, at around 145°, the quotient of the rotation angles ψ/ϕ differs sharply depending on the length L of the coupling element 20, whereby the shorter the selected coupling element 20, the greater the quotient of the rotation angles ψ/ϕ becomes.

The invention is not restricted to the above preferred examples of embodiment. Rather, a number of variations are conceivable which make use of the described solutions, even in fundamentally different designs. All features and/or advantages, including structural details or spatial arrangements set out in the claims, the description or the drawings can be essential to the invention individually or in the most varied of combinations.

LIST OF REFERENCES

100 Starter
10 Tension means roller
11 Tension means
12 Double crank gear
13 Double crank gear
14 Flat side
15 Roller holder element
16 Axis of rotation
17 First joint point
18, 18' Drive element
19 Joint element
20, 20' Coupling element
21 Second joint point
22, 22' Output member
23, 23' Joint element
24 Axis of rotation
25 Grip
26 Power tool
27 Entrainment
L Length of the coupling element
ψ' Rotation angle of the drive element about the first joint point
ϕ Rotation angle of element about the second joint point
D1 First smaller distance
D2 Second larger distance

What is claimed is:

1. A starter for starting a combustion motor, with a rotating tension roller, onto which a tensioner can be wound and which, via active connection, is connected to an entrainment of the combustion motor in order to introduce a rotating movement into the combustion motor, wherein the active connection has at least one double crank gear between the tension roller and the entrainment, wherein the starter is configured to provide the active connection after considerably less than a full rotation of the tension roller.

2. The starter in accordance with claim 1, wherein the active connection has a least two double crank gears between the tension roller and the entrainment.

3. The starter in accordance with claim 1, wherein the tension roller has a flat side, whereby the at least one double crank gear is arranged on the flat side of the tension roller.

4. The starter in accordance with claim 1, wherein the at least one double crank gear having two double crank gears arranged in a position offset by 180° with regard to each other on flat side of the tension roller, whereby, in an arrangement of the several double crank gears, an even distribution over the circumference of the tension roller is provided.

5. The starter in accordance with claim 1, wherein a roller holder with an axis of rotation is provided, on which the tension roller is held rotatably about the axis of rotation, whereby the roller holder provides a resting first joint point of the at least one double crank gear which lies on the axis of rotation.

6. The starter in accordance with claim 5, wherein the tension roller comprises a drive element of the at least one double crank gear, whereby on the tension roller at a distance from the axis of rotation, at least one joint element is provided, and a first end of a coupling element of the double crank gear is arranged on the at least one joint element in an articulated manner.

7. The starter in accordance with claim 5, wherein the roller holder has a resting second joint point of the at least one double crank gear which is provided at a distance from the axis of rotation of the tension roller.

8. The starter in accordance with claim 7, wherein at least one output member is provided which extends between the resting second joint point and a free joint element, and the output member is connected to the coupling element.

9. The starter in accordance with claim 8, wherein the entrainment is connectable to the free joint element.

10. The starter in accordance with claim 8, wherein the free joint element of a first double crank gear of the at least one double crank gear is arranged 180° opposite a second free joint element of a second double crank gear of the at least one double crank gear.

11. The starter in accordance with claim 7, wherein the entrainment has an axis of rotation whereby the second joint point lies in the axis of rotation of the entrainment.

12. A power tool with a starter for starting a combustion motor of the power tool, whereby the starter has a rotating tension roller onto which a tensioner can be wound and which, via an active connection, is connected with an entrainment of the combustion motor in order to introduce a rotating movement into the combustion motor, wherein the active connection between the tension roller and the entrainment has at least one double crank gear, wherein the starter is configured to provide the active connection after considerably less than a full rotation of the tension roller.

13. A power tool with a starter in accordance with claim 1.

* * * * *